United States Patent [19]

Goldsmith

[11] 4,344,721

[45] Aug. 17, 1982

[54] MULTIPLE ANCHORS FOR A TENSION LEG PLATFORM

[75] Inventor: Riley G. Goldsmith, Houston, Tex.

[73] Assignee: Conoco Inc., Ponca City, Okla.

[21] Appl. No.: 175,103

[22] Filed: Aug. 4, 1980

[51] Int. Cl.[3] ..... B63B 35/44; E02B 17/00

[52] U.S. Cl. ..... 405/224; 405/195; 166/341

[58] Field of Search ..... 405/195, 202–208, 405/224–227; 166/338–343; 114/265, 264, 266

[56] References Cited

U.S. PATENT DOCUMENTS

| | | | |
|---|---|---|---|
| 3,050,140 | 8/1962 | Hayes | 166/341 X |
| 3,458,853 | 7/1969 | Daniels et al. | 166/341 X |
| 3,572,044 | 3/1971 | Pogonowski . | |
| 3,611,734 | 10/1971 | Mott . | |
| 3,648,638 | 3/1972 | Blenkarn . | |
| 3,654,886 | 4/1972 | Silverman . | |
| 3,672,177 | 6/1972 | Manning . | |
| 3,676,021 | 7/1972 | Warner . | |
| 3,788,396 | 1/1974 | Shatto et al. | 166/341 |
| 3,919,957 | 11/1975 | Ray et al. . | |
| 3,943,725 | 3/1976 | Pennock . | |
| 3,955,521 | 5/1976 | Mott . | |
| 3,976,021 | 8/1976 | Blenkarn et al. . | |
| 3,982,492 | 9/1976 | Steddum . | |
| 3,986,471 | 10/1976 | Haselton . | |
| 3,996,755 | 12/1976 | Kalinowski . | |
| 4,031,544 | 6/1977 | LaPetina | 166/341 X |
| 4,039,025 | 8/1977 | Burkhardt et al. . | |
| 4,062,313 | 12/1977 | Stram . | |
| 4,109,478 | 8/1978 | Gracia . | |
| 4,126,008 | 11/1978 | Dixon | 405/207 |
| 4,127,005 | 11/1978 | Osborne . | |
| 4,129,009 | 12/1978 | Jansz | 405/227 |
| 4,167,215 | 9/1979 | Thorne | 166/341 |
| 4,169,424 | 10/1979 | Newby et al. | 114/265 |
| 4,174,011 | 11/1979 | Zaremba | 166/341 X |
| 4,181,453 | 1/1980 | Vache | 405/203 |
| 4,226,555 | 10/1980 | Bourne et al. | 405/224 |
| 4,285,615 | 8/1981 | Radd | 405/224 X |

*Primary Examiner*—Dennis L. Taylor
*Attorney, Agent, or Firm*—A. Joe Reinert

[57] ABSTRACT

Apparatus and methods are provided for installing an underwater anchor system including a plurality of separate anchors for a tension leg platform. A cluster of tethering elements is connected between the tension leg platform and each of the separate anchors. Each anchor assembly includes a primary anchor which is first located approximately in a desired position upon the ocean floor. This position includes a lateral location and/or an angular orientation about a vertical axis. Then the position of the primary anchor is ascertained and compared to a desired position of the main anchor. The main anchor is designed to be lowered into engagement with the primary anchor. A relative position determining structure is interconnected between the primary and main anchors for varying the relative position of the main anchor relative to the primary anchor to correct for any difference between the ascertained final position of the primary anchor and the desired position of the main anchor. This relative position determining structure is adjusted as necessary. Then the main anchor is lowered into engagement with the primary anchor so that a location and final angular orientation of the main anchor is determined by the relative position determining structure upon engagement of the main anchor with the primary anchor.

43 Claims, 17 Drawing Figures

MULTIPLE ANCHORS FOR A TENSION LEG PLATFORM

BACKGROUND OF THE INVENTION

1. Field of the Invention

This invention relates generally to subsea anchors and methods of installing the same, and more particularly, but not by way of limitation, to such anchors utilized for anchoring an offshore oil and gas drilling and production platform.

2. Description of the Prior Art

An offshore exploration for oil and gas from subsea deposits has expanded into deeper and deeper waters, conventional rigid towers setting upon the ocean floor and extending upward to the surface have become more and more impractical.

One particular solution to this problem which has been proposed is the elimination of the rigid tower and the substitution therefor of a floating platform moored to the ocean floor by a plurality of vertical members which are placed under high tension loads due to excess buoyancy of the floating platform. Examples of such structures, which are generally referred to as tension leg platforms, are shown in U.S. Pat. No. 3,648,638 to Blenkarn and U.S. Pat. No. 3,919,957 to Ray, et al.

Typically, such a tension leg platform is designed to have a plurality of spaced clusters of vertical tension legs or tethering elements, each of said clusters including a plurality of tethers arranged in a predetermined pattern with all of the clusters additionally arranged in a predetermined pattern relative to each other, so that all of the tethers are arranged substantially vertically between the surface platform and anchors located upon the ocean floor. It is desirable that such tethers be vertically arranged, with no substantial skewing from a vertical line, because the tension variations created in the tethering elements by the forces exerted thereupon by the buoyant surface structure are greater if the tethers are non-vertical as compared to perfectly vertical.

This requires that the relative locations of all of the anchoring positions for the lower ends of the tethers be accurately located upon the ocean floor. The prior art shows several approaches to achieving this goal.

One approach is to construct a single unitary very large structure to be placed upon the ocean floor, which structure includes the anchoring points for each of the tethers and also generally includes connections for production risers or the like, which are to be connected to the floating platform. This solves the problem of providing accurate relative positioning of the tethers, but creates another problem in that the extremely large unitary anchor structure is practically difficult and expensive to manufacture, transport to the offshore drilling site, and to install at a desired location upon the ocean floor. Such structures are shown in U.S. Pat. No. 4,169,424 to Newbey, et al.; U.S. Pat. No. 3,611,734 to Mott; U.S. Pat. No. 3,648,638 to Blenkarn; U.S. Pat. No. 3,676,021 to Blenkarn, et al.; U.S. Pat. No. 3,654,886 to Silverman; and U.S. Pat. No. 4,062,313 to Stram.

Another somewhat different solution to this problem is to construct a unitary anchor structure, portions of which are hinged so as to allow the structure to partially collapse to thereby make it easier to transport, while still maintaining a predetermined spacing of the tether attachment points due to the non-variable relative positioning of those points once the structure is expanded to its final orientation. Such a structure is shown in U.S. Pat. No. 4,126,008 to Dixon.

The use of separate anchors for each cluster of tethering elements has been suggested in U.S. Pat. No. 3,919,957 to Ray, et al.; U.S. Pat. No. 3,982,492 to Steddum; and U.S. Pat. No. 3,996,755 to Kalinowski. The Steddum and Ray, et al. patents appear to disclose the same structure wherein the separate anchors are lowered to the ocean floor directly from the floating structure. The Kalinowski patent merely refers to the anchors as being preplaced without specifying any particular manner for locating and orienting the anchors.

The present invention provides a separate anchor for each cluster of tether elements and provides apparatus and methods for locating and orienting the separate anchors relative to each other and to a drilling template previously located upon the ocean floor. The anchor for each cluster of tethering elements includes a relatively lightweight and small primary anchor which is first set on the ocean floor and a larger main anchor which is subsequently lowered into engagement with the primary anchor. Means are provided for adjusting a position of the main anchor relative to the primary anchor. This is done by adjusting a relative position determining means prior to lowering the main anchor into engagement with the primary anchor. An acoustic positioning system is provided for accurately positioning the primary anchors by accurately ascertaining a lateral location and/or an angular orientation thereof relative to the previously placed drilling template. Based upon that ascertained position, the relative position determining means may be adjusted to finally locate and/or orient the main anchor at the desired position thereof relative to the drilling template and any other anchors which have previously been set. The main anchor is preferably a modular anchor comprising a plurality of interconnected modules, and each of those modules is individually attached to the ocean floor by a drilled and cemented pile.

Some of the elements of the structure of the novel apparatus of the present invention and some of the operations of the novel methods of the present invention are disclosed in the prior art.

Anchors which are attached to the ocean floor by piles driven through the anchors into the ocean floor are shown in the following references:

U.S. Pat. No. 4,039,025 to Burkhardt et al.
U.S. Pat. No. 3,672,177 to Manning
U.S. Pat. No. 3,572,044 to Pogonowski
U.S. Pat. No. 3,648,638 to Blenkarn
U.S. Pat. No. 3,976,021 to Blenkarn et al.
U.S. Pat. No. 3,611,734 to Mott
U.S. Pat. No. 3,654,886 to Silverman
U.S. Pat. No. 3,955,521 Mott
U.S. Pat. No. 3,996,755 to Kalinowski
U.S. Pat. No. 4,127,005 to Osborne
U.S. Pat. No. 4,129,009 to Jansz
U.S. Pat. No. 4,181,453 to Vache
U.S. Pat. No. 4,062,313 to Stram
U.S. Pat. No. 4,126,008 to Dixon.

The use of acoustic beacons to determine location and orientation of items to be set upon the ocean floor is shown in U.S. Pat. No. 4,039,025 to Burkhardt et al., and U.S. Pat. No. 4,181,453 to Vache. Also, off the shelf systems generally adapted for such usage are available including, by way of example, a system sold by Honeywell, Inc. of Houston, Tex. designated by the trademark "RS/906" as described in Honeywell document 3333 Revision A, dated Aug. 15, 1978.

The prior art includes drilling templates which are comprised of temporary guide bases which are initially located on the ocean floor and permanent guide bases which are then lowered into engagement with the temporary guide base. An example of such structures is that sold by Vetco Offshore, Inc. as described in two of its technical bulletins entitled "Early Subsea Production Systems" and "Type SG-5 Wellhead Equipment", respectively. These Vetco systems include modular permanent guide bases which are lowered into engagement with previously positioned temporary guide bases. The anchor assemblies illustrated and described in the following disclosure are modified versions of the equipment previously sold by Vetco Offshore, Inc. for use as drilling template assemblies.

Another two part drilling template having a main template which may be lowered into engagement with a pre-placed template portion, is shown in U.S. Pat. No. 3,572,044 to Pogonowski.

Other references which generally relate to tension leg platforms or the lowering of articles from other floating structures, but which are not believed to be as relative to the present invention as the references more specifically discussed above, include U.S. Pat. No. 4,109,478 to Gracia; U.S. Pat. No. 3,943,725 to Pennock; and U.S. Pat. No. 3,986,471 to Haselton.

SUMMARY OF THE INVENTION

Methods and apparatus are provided for installing an underwater anchor system for a tension leg platform of the type having a plurality of clusters of vertical tethers arranged in a predetermined pattern relative to a drilling template positioned upon a floor of a body of water within which the platform is moored. Seperate anchor assemblies are provided for each cluster of tethering elements. Each anchoring assembly includes a primary anchor and a main anchor. Acoustic beacons are provided at known positions on a previously positioned drilling template and acoustic receiving means are provided on a pipe string with which the primary anchor is lowered or run to the ocean floor. An intermediate position of the primary anchor is ascertained as it is lowered by analyzing acoustic signals transmitted between the acoustic beacon and the acoustic receiving means. Based upon that ascertained intermediate position the primary anchor is placed at a desired final position on the ocean floor relative to the drilling template.

Then by further analysis of the acoustic signals the final position of the primary anchor is determined relative to the drilling template. The final position of the primary anchor is compared to a desired final position of the main anchor and a relative position determining means is adjusted to correct for any difference between the position of the primary anchor and the desired position of the main anchor.

The other anchor assemblies are then placed and oriented in a similar manner so that the final anchoring system including a plurality of separate anchor assemblies provides attachment points in a predetermined pattern so that all of the tethering elements between the platform and the subsea anchors are oriented substantially vertically to thereby minimize the stresses therein.

It is therefore, an object of the present invention to provide improved apparatus and methods for installing an underwater anchor.

Another object of the present invention is to provide an improved apparatus for and method of accurately positioning and orienting anchors for a tension leg platform.

And another object of the present invention is to provide apparatus and methods for locating and orienting anchors utilizing acoustic positioning apparatus and techniques.

Yet another object of the present invention is the provision of a subsea anchor including a primary anchor, a main anchor to be lowered into engagement with the primary anchor, and relative position determining means for positioning the main anchor relative to the primary anchor upon engagement therewith.

Another object of the present invention is the provision of apparatus and methods for adjusting a lateral location of a main anchor relative to a primary anchor.

And another object of the present invention is the provision of apparatus and methods for adjusting an angular orientation of a main anchor relative to a primary anchor.

Other and further objects, features and advantages of the present invention will be readily apparent to those skilled in the art upon a reading of the following disclosure when taken in conjunction with the accompanying drawings.

BRIEF DESCRIPTION OF THE DRAWINGS

FIG. 6 is an elevation view of a primary anchor attached to a drill string.

DETAILED DESCRIPTION OF THE PREFERRED EMBODIMENTS

Figure 1:
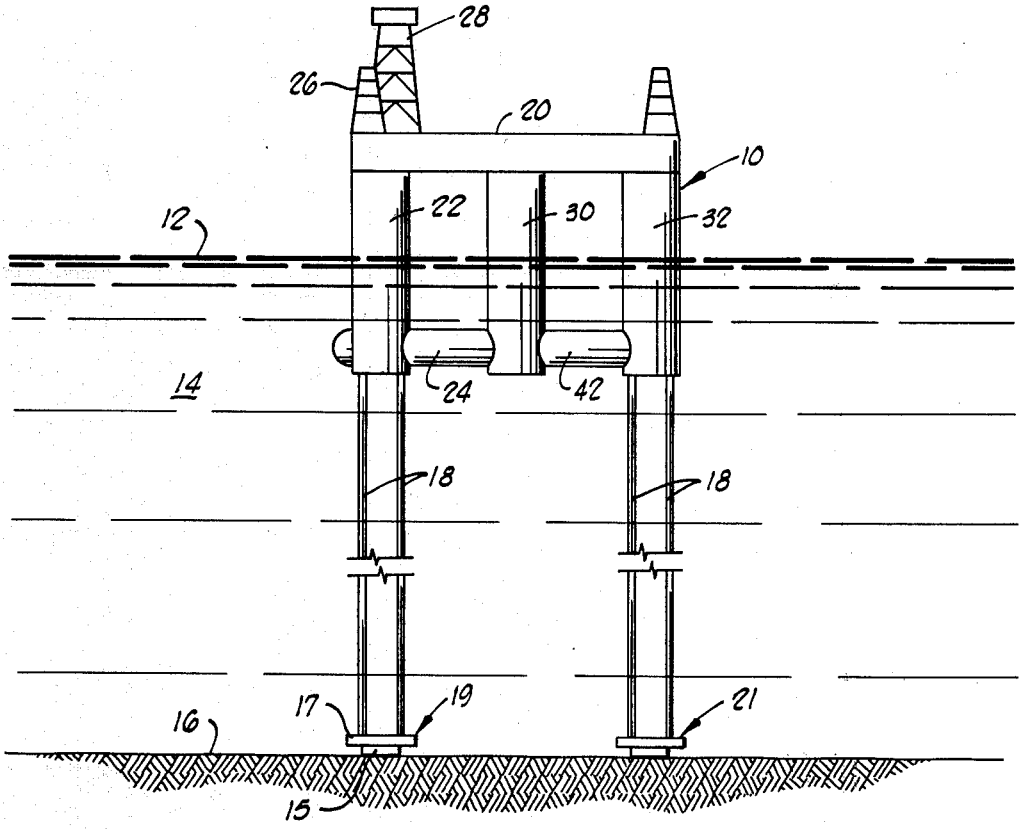
FIG. 1 is a schematic elevation view of a tension leg platform anchored to the ocean floor.

Referring now to the drawings and particularly to FIG. 1, a tension leg platform 10 is thereshown floating upon a surface 12 of a body of water 14 and anchored to a floor 16 of the body of water 14 by a plurality of tension legs or tethering elements 18 connected to anchor assemblies such as 19 and 21.

Each of the anchor assemblies such as anchor assembly 19 includes a primary anchor 15 which is first positioned upon the ocean floor 16 and a main anchor 17 which is then lowered into engagement with primary anchor 15.

The tension leg platform 10 includes a work deck 20 supported by a buoyant structure including a plurality of vertical column members such as 22 and horizontal pontoon members such as 24.

Located above each of the corner columns, such as column 22, is an auxiliary derrick, such as 26, which provides a means for lowering the tethering elements 18 through the corner column 22.

Also located upon work deck 20 is a main derrick 28 which provides a means for performing drilling and production completion operations.

Figure 2:
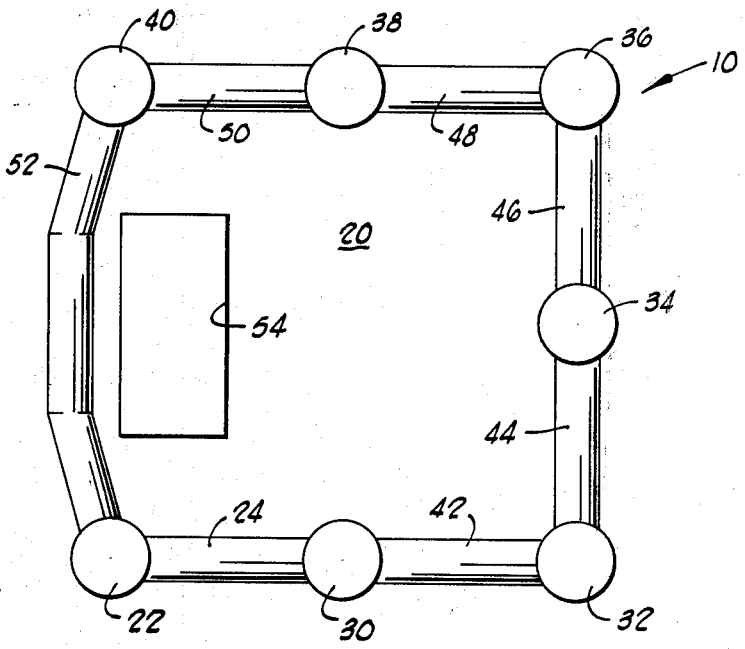
FIG. 2 is a schematic plan view of the main column and pontoon structure of the platform illustrated in FIG. 1.

Referring now to FIG. 2, a somewhat schematic plan view is thereshown of the tension leg platform 10. The work deck 20, lower left corner column 22, and horizontal pontoon section 24 are thereshown. The buoyant structure also includes six other vertical column members designated 30, 32, 34, 36, 38 and 40. Also included are pontoon sections 42, 44, 46, 48, 50 and 52. Disposed within the work deck 20 below the main derrick 28 is a production bay 54 which is an opening within the work deck 20 through which drilling equipment and/or production equipment may be lowered from the main derrick 28 to a well site located upon the floor 16 of the body of water 14.

Each of the corner columns 22, 32, 26 and 40 is constructed so that a cluster of three tethering elements 18 may be lowered therefrom to be connected to anchor assemblies such as 19 and 21 shown in FIG. 1.

Figure 3:
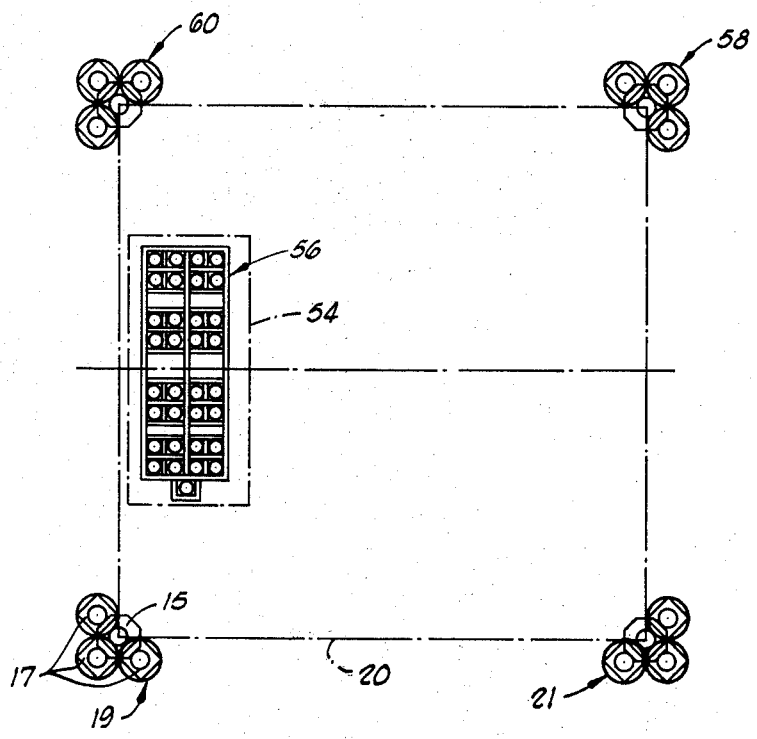
FIG. 3 is a schematic plan view of the relative position of a drilling template and four separate anchor assemblies positioned on the ocean floor, with the outline of the work deck of the platform and a production bay thereof shown in phantom lines.

Referring now to FIG. 3, a plan view is thereshown of a drilling template 56 and anchor assemblies 19, 21, 58 and 60, all in position upon the ocean floor 16.

Each of the anchor assemblies 19, 21, 58 and 60 are positioned directly below corner columns 22, 32, 36 and 40, respectively, of tension leg platform 10. The drilling template 56 is located directly below the production bay 54.

The outline of work deck 20 and the location of production bay 54 are shown in phantom lines in FIG. 3 to represent their position vertically above the ocean floor in relation to the drilling template 56 and the anchor assemblies.

The present invention provides a unique method and apparatus for installing an underwater anchor system comprising the anchor assemblies 19, 21, 58 and 60, for a tension leg platform such as the platform 10.

Generally the drilling template 56 is placed upon the ocean floor 16 prior to the arrival of the tension leg platform 10 and often numerous wells will be drilled through the template 56, by the use of conventional drilling vessels, prior to the arrival of the platform 10. In that manner, once the platform 10 is anchored in place above the drilling template 56, production operations can begin very quickly thereby enhancing the economics of the use of such a tension leg platform.

When using separate anchor assemblies such as the assemblies 19, 21, 58 and 60, each of which is designed to be attached to a cluster of tethering elements 18, it is very important that the anchors be accurately positioned relative to each other so that all of the tethering elements 18 are arranged substantially vertically. If any of the tethering elements 18 are connected in a non-vertical manner between the platform 10 and the ocean floor 16, the tension variations in that tethering element are undesirably increased.

In the following description the terms "position", "lateral locations" and "angular orientation" have certain specific meanings with regard to the placement of anchors upon the ocean floor. "Position" is the broadest of these terms and includes "lateral location" and/or "angular orientation".

"Lateral location" is used to describe the point on the ocean floor at which the anchor is placed, and is sometimes referred to simply by the term "location".

"Angular orientation" is used to describe the manner in which the anchor is rotated about a vertical axis and is similar to the term azimuth as used to describe horizontal directions. The "angular orientation" is sometimes referred to as "angular orientation about a vertical axis" or simply as "orientation".

A change in position can include a change in lateral location only, a change in angular orientation only, or a change in both.

The following example shows the importance of accurately positioning the anchor assemblies. A one-percent of water depth error in lateral location of the anchor assemblies in water approximately 500 feet deep is estimated to cause an approximately 10% increase in the tension variations in the tethering element 18. Likewise, a 2° error in angular orientation of the anchor assemblies, causes an estimated 6 to 7% increase in tension variation in the tethering elements.

As previously mentioned, an anchor system including a plurality of separate anchor assemblies is very desirable because of the ease of constructing and transporting the separate anchor assemblies as compared to a unitary anchor assembly covering an area approximately the same size as the entire work deck 20 of the platform 10.

An acceptable system of separate anchors, however, must include a means for accurately positioning the separate anchor assemblies relative to the drilling template 56 and to each other, so as to prevent excessive tension variations in the tethering elements. The present invention provides a combination of features which achieve the necessary accuracy in positioning these separate anchor assemblies.

As previously described and shown schematically in FIG. 1, the anchor assembly 19, which is merely an example of all of the anchor assemblies, includes a primary anchor 15 which is first positioned on the ocean floor 16, and a main anchor 17 which is then lowered into engagement with the primary anchor 15.

The use of a relatively small primary anchor 15 permits that primary anchor 15 to be much more easily and accurately positioned on the ocean floor relative to the template 56 as compared to the difficulty of accurately positioning a larger structure.

After the anchor 15 is located upon the ocean floor, its position relative to the drilling template 56 may be accurately ascertained and then a relative position determining means may be adjusted so as to provide the desired relative positioning between primary anchor 15 and main anchor 17 upon the later engagement therebetween, so that the main anchor 17 is finally positioned in a desired position relative to the drilling template 56.

The ascertainment of the position of these various components is accomplished by the use of acoustic devices. A plurality of acoustic transmitting means 62, which preferably are acoustic transponders, are placed at known positions on the drilling template 56. These transponders 62 may, of course, be placed on the drilling template 56 before it is positioned on the ocean floor.

The primary anchors such as primary anchor 15 are lowered to the ocean floor 16 upon a conventional drill string or running string 63 (See FIG. 6) from a conventional drilling vessel (not shown). Located upon the running string 63 and/or the primary anchor are acoustic receiving means 64. In FIG. 6 the acoustic receivers 64 are attached to arms 65 extending from running string 63, and monitoring cables 67 transmit signals to the surface.

Figure 4:
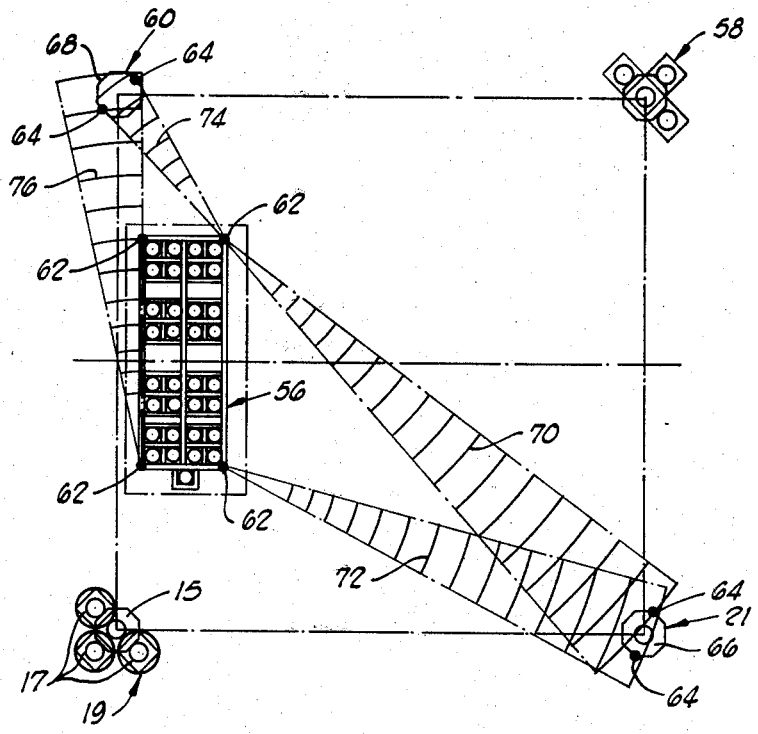
FIG. 4 is a view somewhat similar to FIG. 3 showing two of the anchor assemblies in place and showing the primary anchors of the other two anchor assemblies being positioned by the use of acoustic methods.

For example, in FIG. 4, the anchor assemblies 19 and 58 are shown already positioned. The anchor assemblies 21 and 60 are in the process of being assembled. Primary anchors 66 and 68 of anchor assemblies 21 and 60, respectively, are shown in a position which may be considered either as already being upon the ocean floor or as being lowered toward a desired position upon the ocean floor.

Acoustic signals are schematically represented at 70, 72, 74 and 76, being transmitted from the acoustic transmitting means 62 to various acoustic receiving means 64. Those acoustic signals may be analyzed by methods well known to those skilled in the art to determine the position of the various acoustic receiving means relative to the various acoustic transmitting means 62, and to thereby determine the positions of the primary anchors 66 and 68 relative to the drilling template 56. Of course, it may be that only one of the primary anchors will be set at one time. It is not necessary that the primary anchors 66 and 68 be positioned simultaneously.

Figure 10:
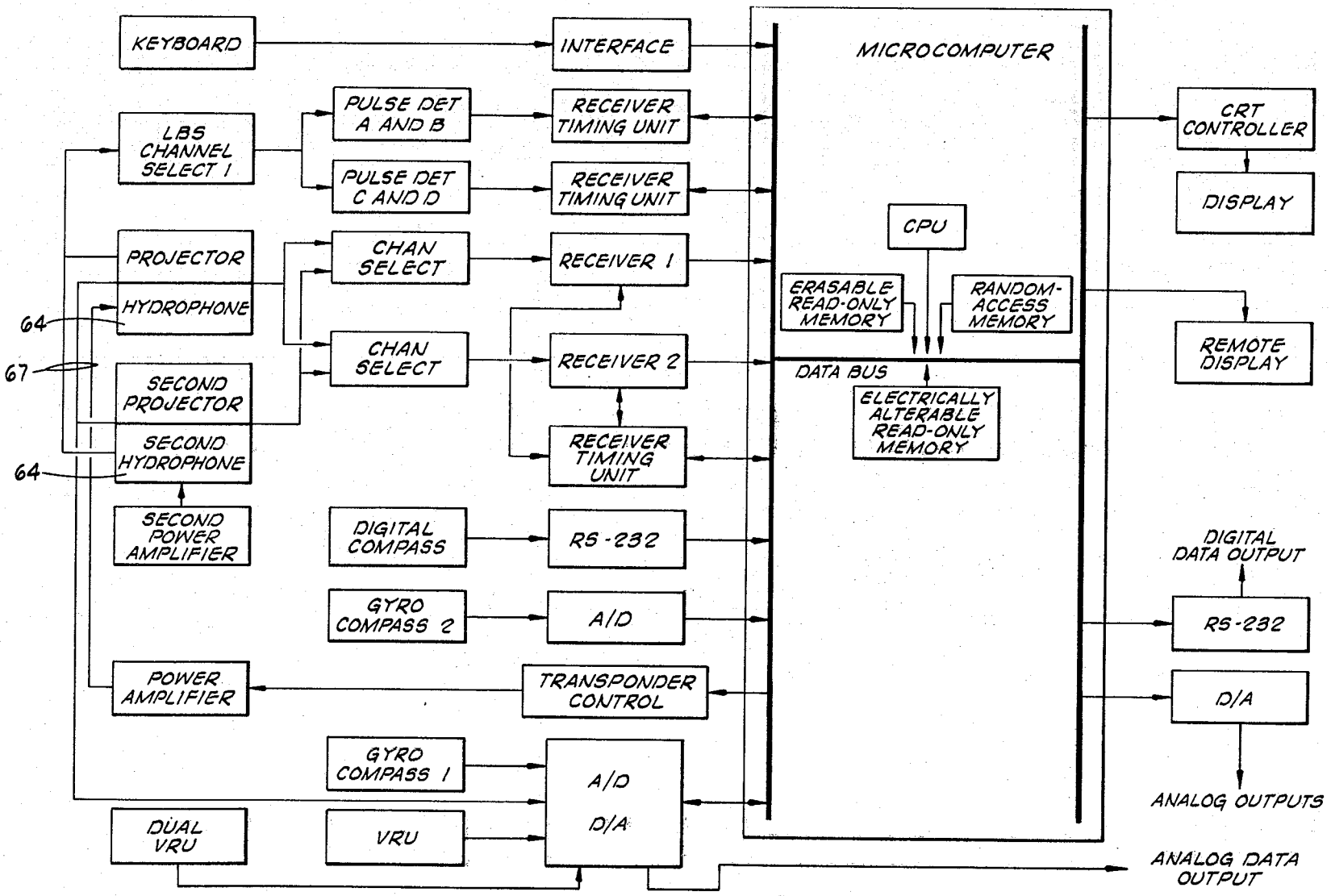
FIG. 10 is a functional block diagram of the acoustic receiving means and signal analyzing means.

An acoustic position sensing system suitable for use with the other components of the present invention is that sold by Honeywell, Inc. of Houston, Tex. and designated by the trademark "RS/906" as described in Honeywell Document 3333, Revision A, dated Aug. 15, 1978. Such a system generally includes a beacon such as the acoustic transmitting means 62, a hydrophone/projector such as acoustic receiving means 64, a signal processor, power amplifier, vertical reference unit (VRU) and a display console. A functional diagram of those components other than beacons 62 is shown in FIG. 10, which is taken from the Honeywell Document referenced above.

With this type of acoustic positioning system the inherent errors in ascertaining lateral location of one object, e.g. anchor assembly 19, relative to another object, e.g. drilling template 56, is about one per-cent of the distance between the objects.

An independent check upon the final orientation of primary anchor 15 may be obtained by using a conventional directional drilling survey instrument run through an inner bore of drill string 63.

Figure 5:
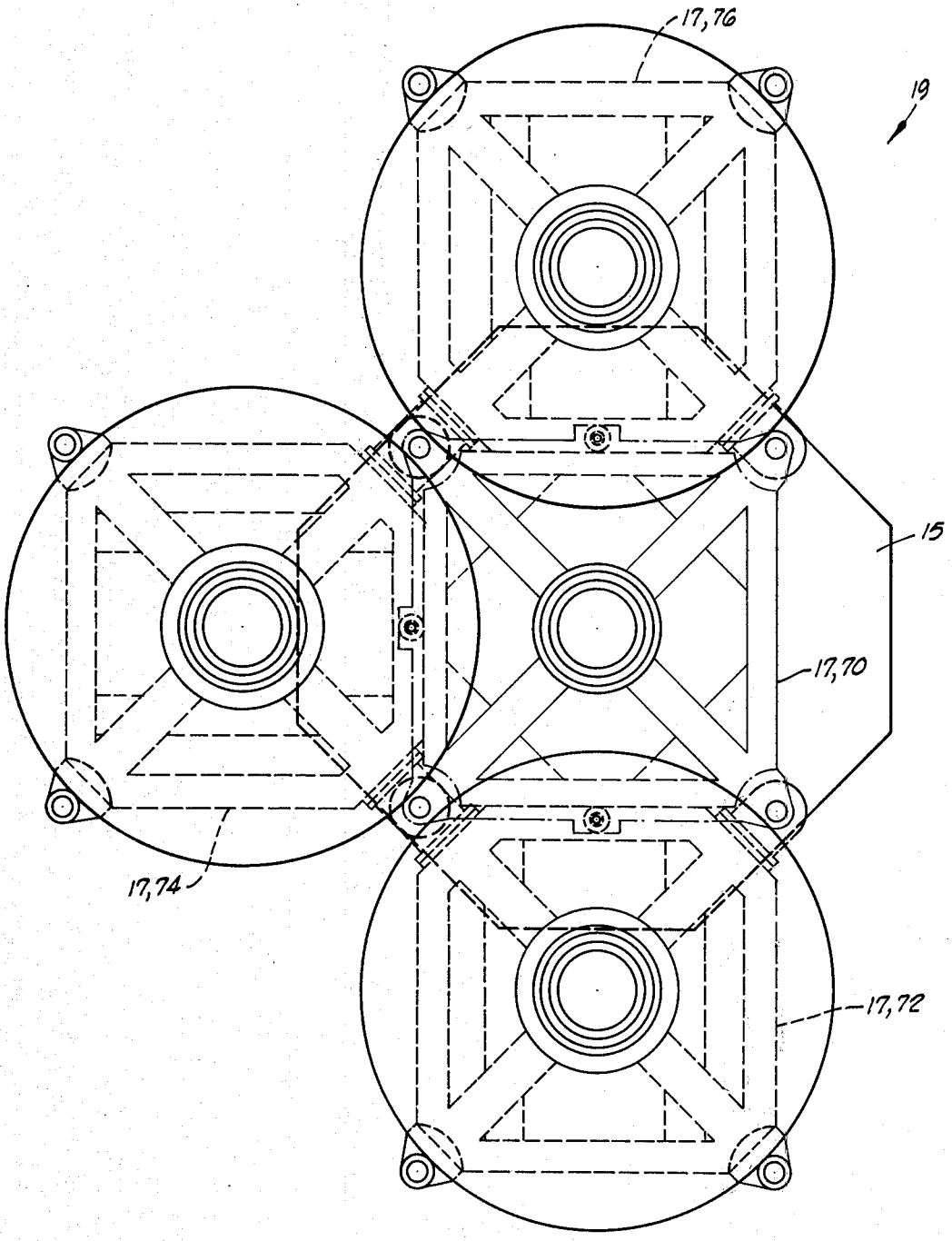
FIG. 5 is a plan view of one of the anchor assemblies of the present invention.

Referring now to FIG. 5, a much more detailed plan view is thereshown of one of the anchor assemblies, which for purpose of illustration is designated as being the anchor assembly 19. In FIG. 5, the primary anchor 15 and the main anchor 17 are shown. The main anchor 17 illustrated in FIG. 5 is a modular main anchor comprising first, second, third and fourth modules 70, 72, 74 and 76, respectively.

When using a modular main anchor such as the main anchor 17, the first module 70 thereof is the first one to be lowered into engagement with primary anchor 15, and the previously mentioned relative position determining means interconnected between the first module 70 of the main anchor 17 and the primary anchor 15. The additional modules 72, 74 and 76 are then lowered into engagement with and attached to the first module 70 so that their positions are predetermined by the means provided for attaching them to the first module 70. Once the first module 70 is positioned at a desired location and oreintation, the location and orientation of the other modules 72, 74 and 76 is then necessarily determined thereby.

Figure 7:
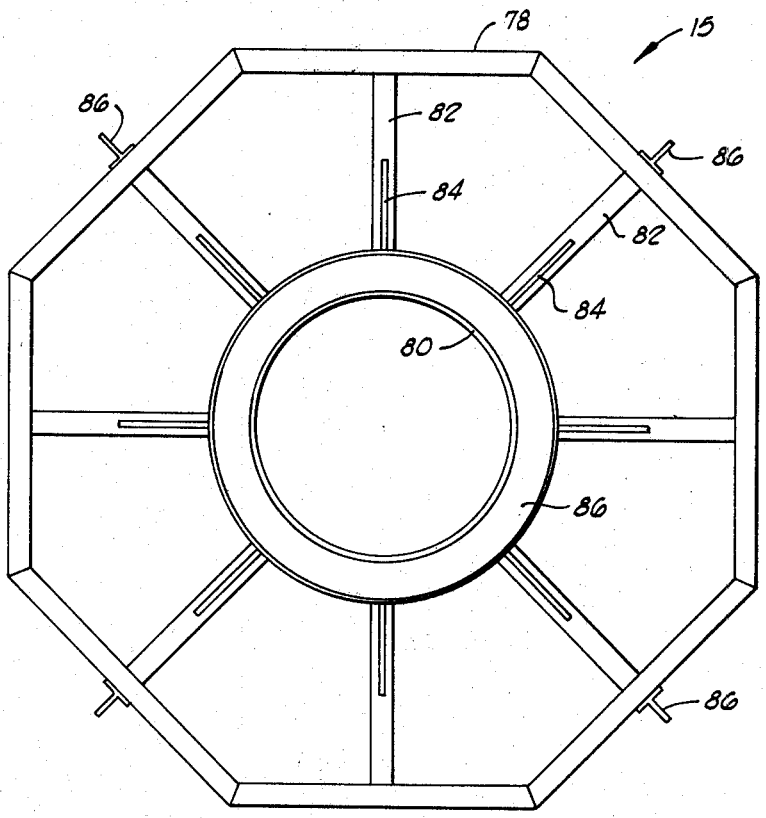
FIG. 7 is a plan view of the primary anchor of FIG. 6.
Figure 8:
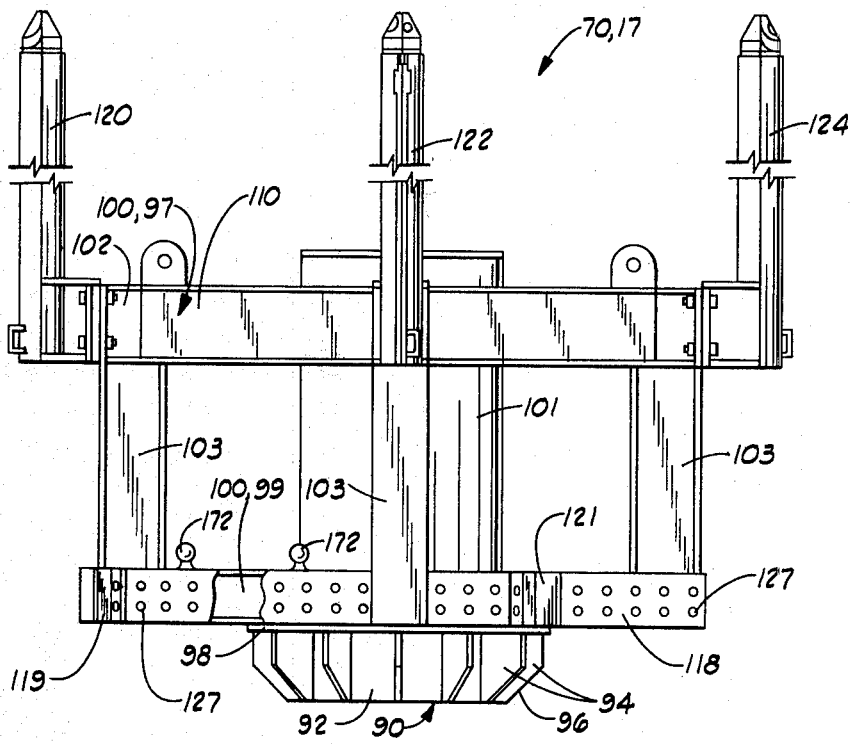

Referring to FIGS. 6 and 7, side elevation and plan views, respectively, are thereshown, of the primary anchor 15.

The primary anchor 15 is very similar to prior art drilling templates generally referred to as temporary guide bases such as those manufactured by Vetco Offshore, Inc. and described above, for use in drilling a subsea well.

The primary anchor 15 includes an octagonal outer frame 78 attached to a cylindrical inner guide member 80 by a plurality of spider arms 82 which are strengthened by gusset plates 84. Extending downward from octagonal outer frame 78 are four legs 86 which are embedded in the ocean floor 16 when the primary anchor 15 is lowered into contact therewith.

Attached to the upper end of cylindrical guide member 80 and also attached to the gusset plates 84 is a conical member 86 for receiving an engaging portion of the first module 70 of main anchor 17.

Figure 8:
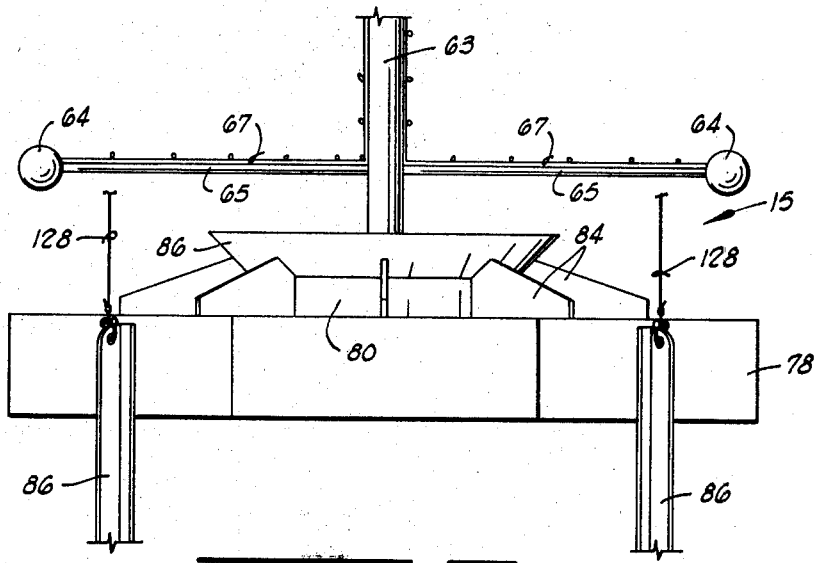
FIG. 8 is a side elevation view of a first module of a modular main anchor having a portion of the mounting ring of the adjustment means thereof cut away.
Figure 9:
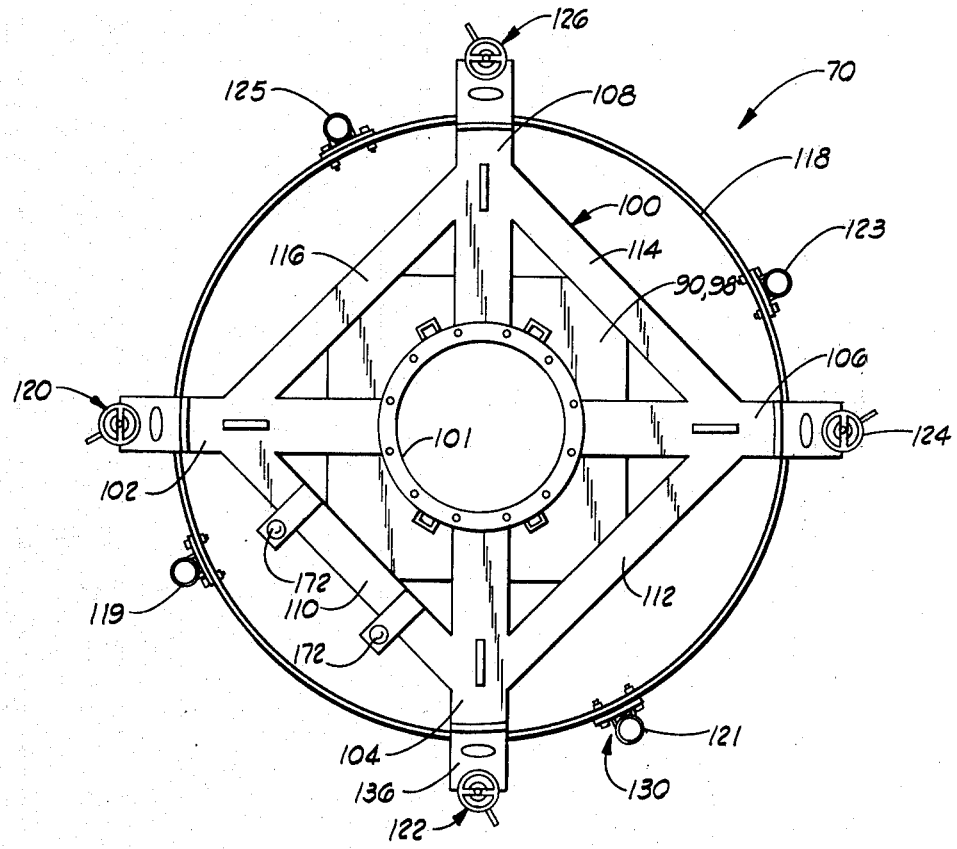
FIG. 9 is a top plan view of the first module of the main anchor shown in FIG. 8.

Referring now to FIGS. 8 and 9, side elevation and plan views are thereshown of the first module 70 of main anchor 17.

First module 70 includes a lower nose member 90 designed to be closely received within the conical section 86 of primary anchor 15. The nose member 90 includes a cylindrical inner portion 92 having a plurality of radially outward extending gusset plates 94 extending therefrom, each having lower outward tapered surfaces 96 which are sloped to correspond to the slope of conical member 86. The cylindrical member 92 and gusset plates 94 all extend downward from a horizontal mounting plate 98 of the nose member 90.

The mounting plate 98 is attached to the lower side of a main structural framework 100. Framework 100 includes an upper part 97, a lower part 99, and a plurality of vertical connecting members 103. As seen in FIG. 9, upper part 97 includes four radially outward extending arms 102, 104, 106, and 108, extending from a central cylindrical pile guide means 101, which are interconnected by bracing portions 110, 112, 114 and 116.

Attached to the outer ends of radial arms 102, 104, 106 and 108 are first, second, third and fourth guideline follower posts 120, 122, 124 and 126.

Attached to lower part 99 of framework 100 is a circular mounting ring 118. Bolted to the mounting ring 118 are first, second, third and fourth guide eyelets 119, 121, 123 and 125.

As is seen in FIG. 8, the mounting ring 118 includes a plurality of bolt holes 127 which allow the location of the guide eyelets to be varied. The guide eyelets are preferably maintained at an angular spacing of 90° relative to each other.

When primary anchor 15 is located upon the ocean floor it has a plurality of guidelines 128 (see FIG. 6) extending upward therefrom to a conventional drilling vessel (not shown) which is used to set the anchors. Guidelines 128 are attached to primary anchor 15 before it is lowered to the ocean floor 16. Prior to lowering the first module 70, those guidelines 128 are disposed through the guide eyelets 119, 121, 123 and 125. The guide eyelets may generally be described as follower means for following guidelines 128.

The relative angular orientation of main structural framework 100 of first module 70 relative to the main anchor 15 is therefore determined by the location of the guide eyelets 119, 121, 123 and 125 upon the mounting ring 118. The guide eyelets 119, 121, 123 and 125, mounting ring 118, and guidelines 128 may be collectively referred to as a relative position determining means 130 interconnected between primary anchor 15 and first module 70 of main anchor 17.

Figure 11:
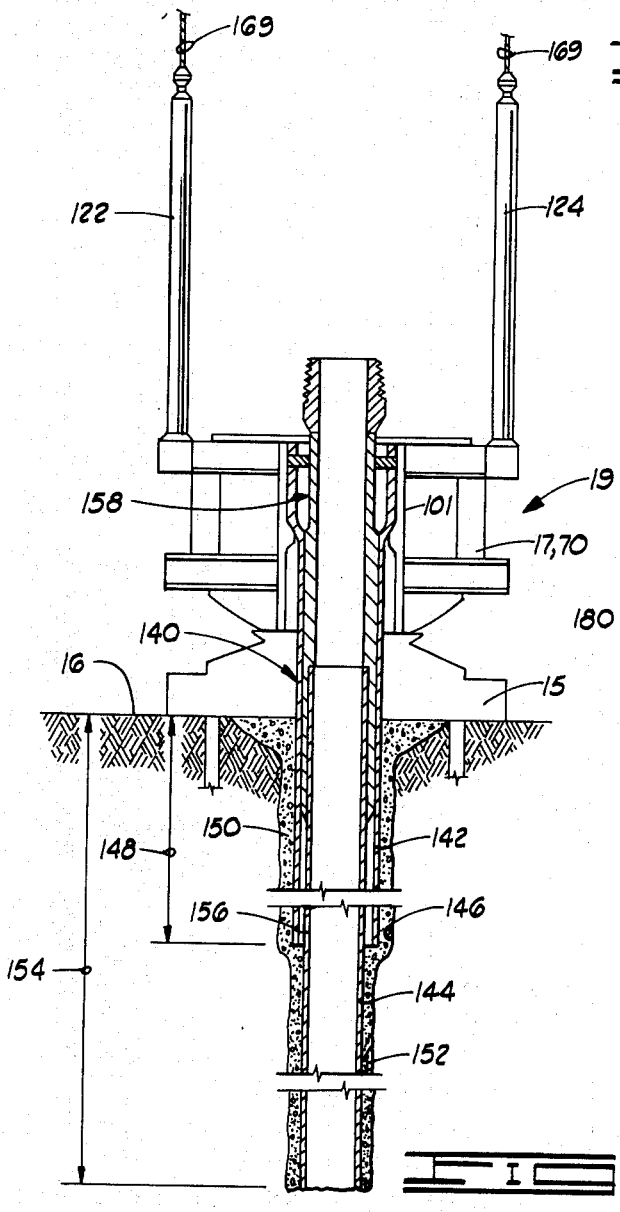
FIG. 11 is a schematic elevation of a primary anchor and a first module of a modular main anchor attached to the ocean floor by a drilled and cemented pile.

Referring now to FIG. 11, a schematic elevation sectioned view is thereshown of first anchor assembly 19 in place upon the ocean floor 16, said anchor assembly being rotated 45° clockwise as viewed from above relative to the position of first module 70 shown in FIGS. 8 and 9.

FIG. 11 illustrates a first pile means 140 which attaches the anchor assembly 19 to the ocean floor 16. The first pile means 140 includes a larger diameter pile section 142 and a smaller diameter pile section 144. The pile means 140 is constructed by first drilling a larger diameter hole 146 through the pile guide means 101 of first module 70 and the cylindrical guide member 80 of primary anchor 15 to a first depth 148 within the floor 16. The larger diameter casing section 142 is then cemented as shown at 150 within the first hole 146. Then a smaller diameter hole 152 is drilled concentrically within larger diameter casing section 142 to a second depth 154 greater than the first depth 148. The smaller diameter pile section 144 is then placed within the smaller diameter hole 152 with an upper end 156 of the smaller diameter pile section 144 extending upward through the larger diameter pile section 142.

Connected to the smaller diameter pile section 144 is an anchor attachment means 158 which structurally connects the piling 140 to the anchor assembly 19.

As previously mentioned, the anchor assembly 19 is constructed from components similar to those previously known as temporary guide bases and permanent guide bases of drilling template assemblies, and the anchor attachment means 158 may therefore be constructed in a manner similar to a conventional wellhead such as is normally used with drilling templates.

Additional pile means (not shown) are used to attach each of the additional modules 72, 74 and 76 of the main anchor 17 shown in FIG. 5 to the ocean floor 16. The pile means utilized with each of those additional modules is directly connected to a tethering element 18 by the use of connectors which may be constructed in a manner similar to typical wellhead connectors which may be either hydraulically or mechanically actuated to connect the lower end of the tethering element to the anchor attachment means 158 shown in FIG. 11.

By utilizing this construction of anchor assembly 19, the tethers 18 are attached to the central smaller diameter pile sections so that each pile carries the axial load of one tether. Lateral loads are transferred between piles by the main anchor 17.

Figure 12:
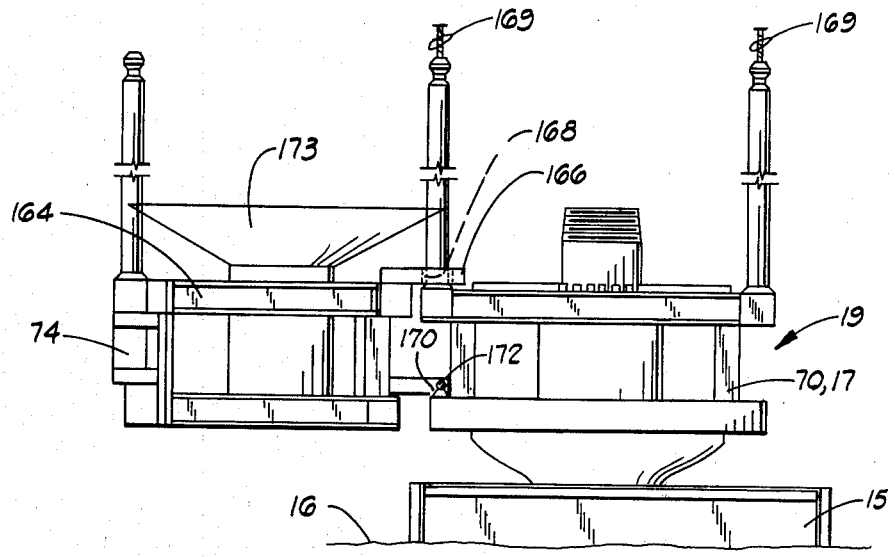
FIG. 12 is a side elevation view similar to FIG. 11 showing a second module of the modular main anchor attached to the first module thereof in a cantilever fashion.

Referring now to FIG. 12, a view somewhat similar to that of FIG. 11 is shown with the third module section 74 attached thereto.

The third module 74 includes a framework 164. Two rings 166, having openings 168 therein, extend laterally from an upper part of framework 164. A second set of guidelines 169 extend from follower posts 120 and 122 of first module 60 and are placed through the openings 168 so that third module 74 is guided to a position adjacent first module 70 as shown in FIG. 12 when third module 74 is lowered. Third module 74 also includes ball receiving openings 170 which fits over balls 172 of frame 100 of first module 70 to further attach the modules 70 and 74. Balls 172 and openings 170 function similar to a ball and socket type trailer hitch.

A tether guide cone 173 is attached to framework 164 for guiding a tether 18 into engagement with a wellhead type connector attached to the pile means of third module 74.

Figure 13:
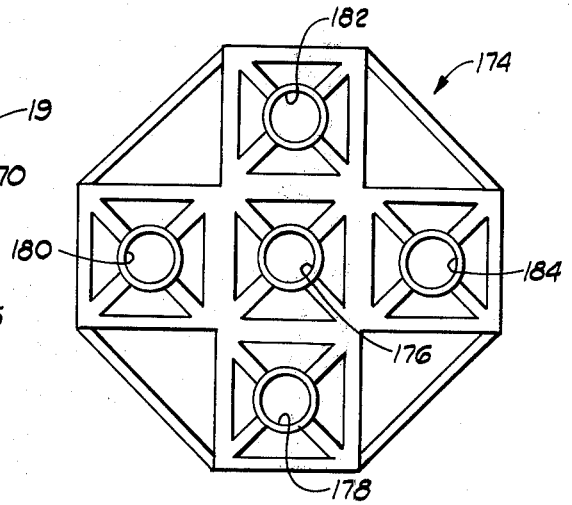
FIG. 13 is a plan schematic view of a unitary main anchor.

Referring now to FIG. 13, a schematic plan view is thereshown of a unitary main anchor 174 which includes a center pile guide 176 and first, second, third and fourth outer pile guides 178, 180, 182 and 184, respectively. The structure directly surrounding the center pile guide 176 and located therebelow performs a function equivalent to that of the first module 70 of the module main anchor 17 of FIG. 5, and the first, second and third outer pile guides 178, 180 and 182 are analogous to the second, third and fourth modules 72, 74 and 76, respectively. The fourth outer guide member 170 shows a means for adding a fourth tethering element to each of the four clusters descending from the corner columns 22, 32, 36 and 40. A four tether arrangement can be provided with the module main anchor 17 by adding a fourth cantilevered section to the right of first module 70.

Figure 14:
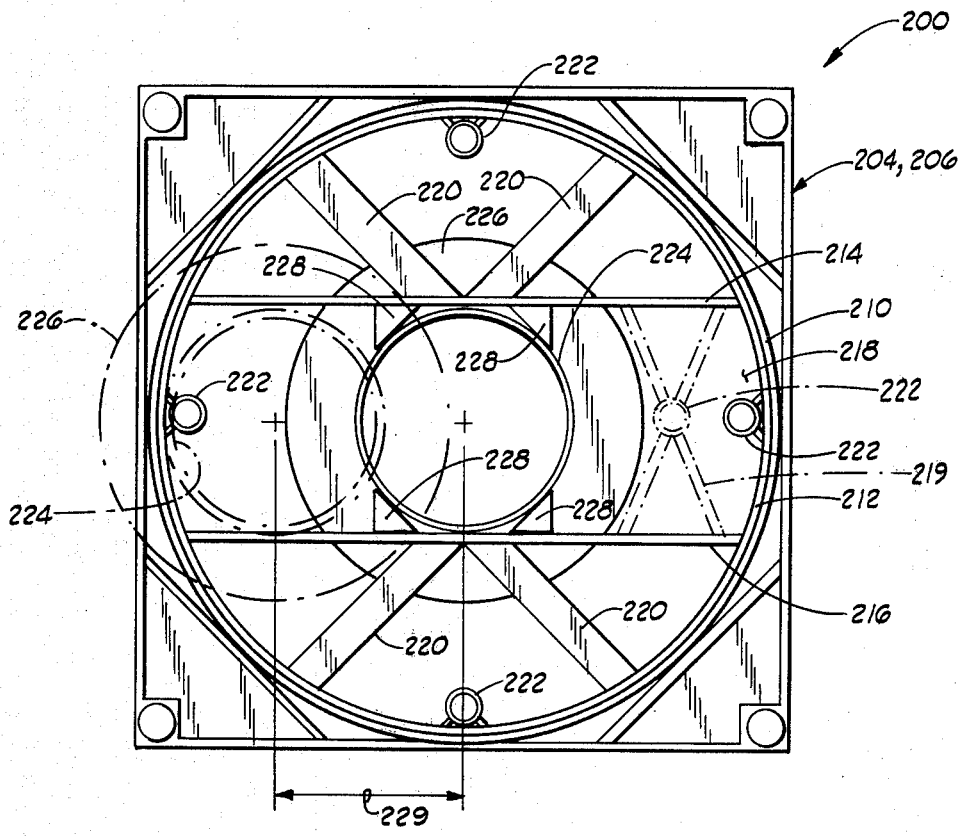
FIG. 14 is a plan view of an alternative form of main anchor which provides adjustment of both lateral location and angular orientation.
Figure 15:
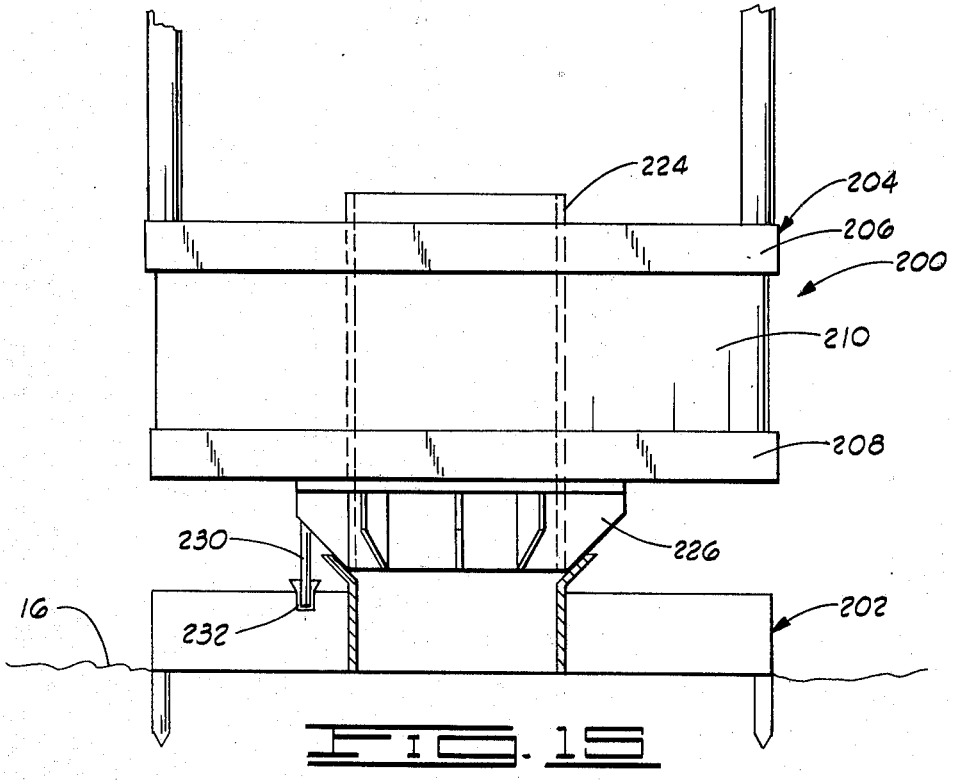
FIG. 15 is an elevation view of the main anchor of FIG. 14 engaged with a primary anchor.

Embodiment of FIGS. 14 and 15

FIG. 14 shows an alternative design for a main anchor 200 which provides relative adjustment of both lateral location and angular orientation. FIG. 15 shows main anchor 200 engaged with a primary anchor 202.

Main anchor 202 includes a framework 204, having an upper box portion 206, a lower box portion 208 and a cylindrical frame portion 210 attached at its upper and lower ends to box portions 206 and 208. Cylindrical portion 210 is fixedly attached to box portions 206 and 208 such as by welding or bolting.

Received within cylindrical portion 210 is a rotatably adjustable inner cylindrical sleeve 212. Extending chordwise across sleeve 212 are vertical plates 214 and 216 which define a horizontally extending slot 218 therebetween, as seen in FIG. 14. Plates 214 and 216 are braced by a plurality of braces 220.

Disposed about an inner circumference of sleeve 212 are a plurality of guide eyelets 222 which function in the same manner as the guide eyelets 119, 121, 123 and 125 of FIG. 9. Guide eyelets 222 are preferably welded in place. One of the eyelets 222 may be laterally positioned within slot 218 by the use of bracing 219 as shown in phantom lines.

A vertical pile guide cylinder 224 is disposed in slot 218. Pile guide cylinder 224 has a nose member 226 attached to a lower end thereof. Nose member 226 is similar to nose member 90 of FIGS. 8 and 9.

The location of vertical pile guide cylinder 224 is adjustable by sliding it horizontally within slot 218. When pile guide cylinder 224 is located as desired within slot 218 it is fixed relative thereto with chocks 228 which may be welded or bolted to pile guide cylinder 224 and plates 214 and 216. For example, the pile guide cylinder may be moved to the left a distance 229 to the position shown in phantom lines in FIG. 14.

The angular orientation of vertical pile guide cylinder 224 is adjustable relative to framework 204 by rotation of sleeve 212 within cylindrical portion 210 of framework 240. When sleeve 212 is located as desired within cylinder 210 it is fixed thereto by welding or bolting.

As shown in FIG. 15, a stub 230 extends downward from nose member 226 for engagement with a cup 232 of primary anchor 202. Thus the position of pile guide cylinder 224 is fixed relative to primary anchor 202. The position of main anchor 200 relative to primary anchor 202 is adjusted by adjusting the location and angular orientation of pile guide cylinder 224 within framework 204.

The main frame 200 depicted in FIGS. 14 and 15 is a first module of a modular main frame similar to that of FIG. 5. The design of the relative position determining means of main anchor 200, could of course be utilized also with a unitized main anchor such as that of FIG. 13.

Figure 16:
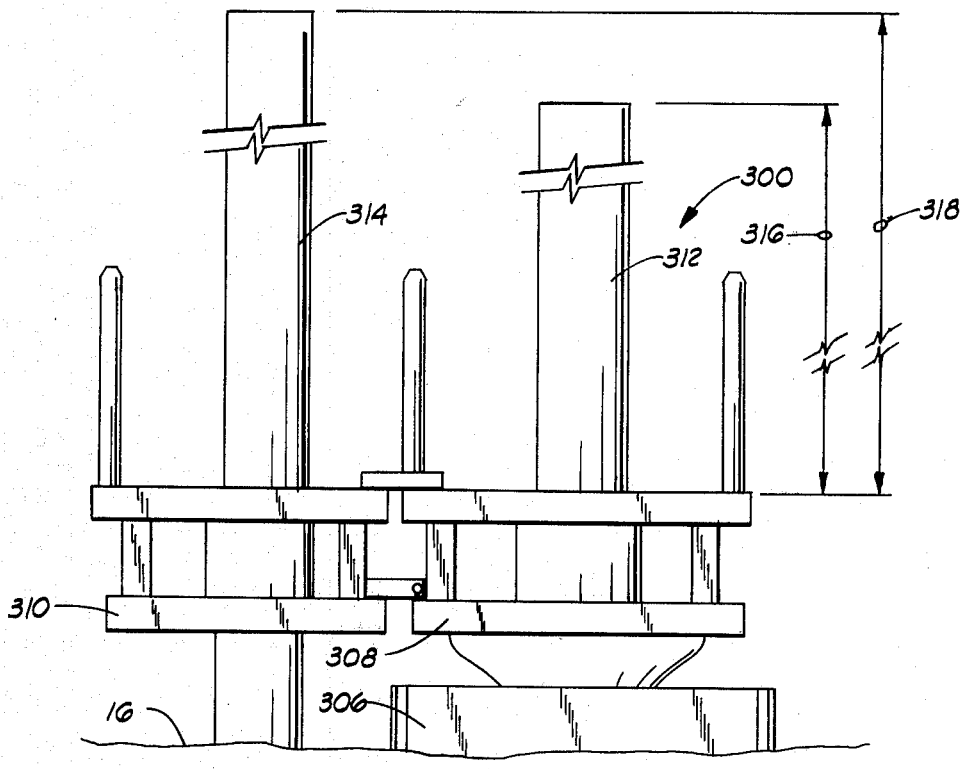
FIG. 16 is an elevation view of an alternative form of primary anchor for use with the main anchor of FIG. 17.
Figure 17:
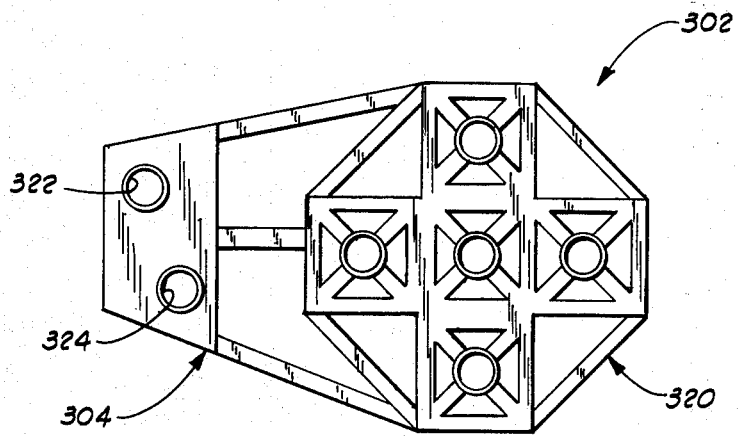
FIG. 17 is a plan view of an alternative form of main anchor having a custom fabricated relative position determining means.

Embodiment of FIGS. 16 and 17

FIG. 16 is an elevation view of an alternative primary anchor 300. In FIG. 17 a plan view of an alternative main anchor 302, having a custom fabricated position determining means 304 designed for use with primary anchor 300, is shown.

The primary anchor 300 includes a temporary guide base 306, a first modular permanent guide base 308, a second module guide base 310, and first and second piles 312 and 314 set in ocean floor 16 through guide bases 308 and 310.

First pile 312 extends upward a distance 316 above module 308. Second pile 214 extends upward a distance 318 above module 308. Distances 316 and 318 are preferably on the order of six and ten feet, respectively.

For the embodiment of the present invention illustrated in FIGS. 16 and 17, the structure illustrated in FIG. 16 comprises only a primary anchor. The piles 312 and 314 are preferably offset somewhat from a position where the main anchor 302 is desired to be placed, for reasons further explained below.

The main anchor 302 includes an octagonal frame 320 similar to that of unitary main anchor 174 of FIG. 13.

After the primary anchor 300 is constructed, as shown in FIG. 16, its position on ocean floor 16 is determined by the acoustic means previously described.

Then the custom fabricated position determining means 304 is constructed so that when pile followers 322 and 324 thereof are placed over piles 312 and 314, respectively, the octagonal frame 320 is positioned at its desired position.

Custom fabricated portion 304 is constructed of conventional structural beams and plates.

It will be understood from viewing FIG. 17, that the position of primary anchor means 300 must be offset from the desired final position of framework 320 of main anchor 302.

OPERATION

The manner of operation of the present invention may generally be summarized as follows with reference to the embodiment of FIGS. 3–12. A method and apparatus are provided for installing an underwater anchoring system for the tension leg platform 10. The tension leg platform 10 is of the type having first, second, third and fourth clusters of vertical tethering elements 18 located below the corner columns 22, 32, 36 and 40, respectively, with each of said clusters being arranged in a predetermined pattern relative to the drilling template 56 previously located upon the floor 16 of the body of water. For example, the pattern of the tethers 18 is shown in FIG. 3.

The operation is initiated by lowering the first primary anchor 15 to a desired position on the floor 16 such as is shown in FIG. 3. This is done by lowering the first primary anchor 15 on a running string 63 as previously described and ascertaining the position of the first primary anchor 15 as it is lowered by use of the acoustic methods previously described with relation to FIG. 4. In that manner, the position of first primary anchor 15 above the floor 16 may be varied as the first primary anchor 15 is lowered toward the ocean floor 16 so that it may be placed at the desired position on the floor 16. If, when the first primary anchor 16 is first placed upon the ocean floor 16, it is determined not to be at a desired position, it may be moved by lifting the drilling string 63 and varying the position thereof by moving the drilling vessel to which it is attached or rotating the drill string.

After the first primary anchor is positioned at approximately the desired position thereof upon the ocean floor, its final position relative to the drilling template 56 is then determined by the acoustic means previously described with regard to FIG. 4.

The position of the first primary anchor is then compared to the desired position illustrated in FIG. 3 for the first main anchor 17. The relative position determining means 130 is constructed to allow adjustment of the relative angular orientation between primary anchor 15 and main anchor 17. If the final angular orientation of primary anchor 15 is such that when the first module 70 of main anchor 17 is lowered into engagement with the first primary anchor 15, the first module 70 will not be angularly oriented at the desired angular orientation thereof, then it is necessary to adjust the position of the guide eyelets 119, 121, 123 and 125 as previously described with regard to FIGS. 8 and 9, to correct for the difference between the angular orientation of first primary anchor 17 and the desired angular orientation of first main anchor 15.

Then the guide eyelets 119, 121, 123 and 125 are disposed about the guidelines 128 and the first module 70 of first main anchor 17 is lowered into engagement with the first primary anchor 15 so that a location and final angular orientation of the first main anchor 17 is determined by the relative positioning determining means 130 upon engagement of first module 70 of main anchor 17 with primary anchor 15.

After the first anchor assembly 19 has been installed, then the second primary anchor 66 of the second anchor assembly 21 is positioned upon the ocean floor 16 in a similar manner relative to at least one of the drilling template 56 and the first anchor assembly 15. This is preferably done by using the acoustic transmitting means 62 upon drilling template 56, but it will be understood by those skilled in the art that acoustic transmitting means 62 could also be provided upon the first anchor assembly 19 which has already been positioned relative to the drilling template 56, and the second anchor assembly 21 could then be located and angularly oriented relative to the first anchor assembly 19. The location and angular orientation of the primary anchor 66 of second anchor assembly 21 is determined in a manner similar to that previously described and then the main anchor of second anchor assembly 21 is lowered into engagement with a primary anchor 66 in a manner similar to that previously described for the first anchor 17.

Then in a similar fashion the third and fourth anchor assemblies 58 and 60 are positioned and assembled. It will be understood by those skilled in the art that any one of the anchor assemblies could be located relative to the drilling template 56 and the others could be located in any order and their location and orientation could be determined relative to any of the anchor assemblies previously placed or to the drilling template 56.

The attachment of each of the anchor assemblies to the ocean floor 16 by the use of cemented piles as previously described with regard to FIG. 11 is preferably done in the following order. Referring, merely by way of example, to the first anchor assembly 19, the primary anchor 15 is first located upon the ocean floor. Then the angular orientation thereof is determined and the first module 70 of main anchor 17 is then installed thereon with a correct adjustment being made for the relative angular orientations between the primary anchor 15 and the module 70 of main anchor 17.

Then the larger diameter hole 140 is drilled and the larger diameter pile section 142 is placed therein and cemented in place. Thereafter, the second, third and fourth modules 72, 74 and 76, are sequentially lowered into place adjacent first module 70 and attached thereto.

Next the larger diameter pile sections for the second, third and fourth modules 72, 74 and 76 are drilled and cemented in place. Finally, the longer, smaller diameter pile sections such as section 144 shown in FIG. 11, are drilled and cemented in place.

If necessary, prior to the drilling and placement of the larger diameter pile sections for the second, third and fourth modules 72, 74 and 76, the longer diameter pile section 144 for the first module 70 may be drilled and cemented in place so as to further anchor the whole anchor assembly prior to the drilling of the holes for the pile means and for the second, third and fourth modules 72, 74 and 76.

Thus, it is seen that the multiple anchor system for a tension leg platform of the present invention is readily adapted to achieve the ends and advantages mentioned as well as those inherent therein. While certain preferred embodiments of the invention have been illustrated for the purposes of this disclosure, numerous changes in the arrangement and construction of parts may be made by those skilled in the art which changes are encompassed within the scope and spirit of this invention as defined by the appended claims.

The embodiments of the invention in which an exclusive property or privilege is claimed are defined as follows:

1. A method of installing an underwater anchor assembly, said method comprising the steps of:

lowering a primary anchor to a floor of a body of water;

ascertaining a final position of said primary anchor upon said floor, said position including at least one of a lateral location upon said floor and an angular orientation about a vertical axis;

comparing said ascertained position of said primary anchor to a desired position of a main anchor;

adjusting a relative position determining means, for determining a position of said main anchor relative to said primary anchor upon engagement of said main anchor with said primary anchor, and thereby correcting as necessary for any difference between said ascertained position of said primary anchor and said desired position of said main anchor; and lowering said main anchor into engagement with said primary anchor so that a final position of said main anchor is determined by said relative position determining means, said final position being said desired position of said main anchor.

2. The method of claim 1, wherein said step of lowering the primary anchor to the floor of the body of water further comprises the steps of:

providing acoustic transmitting means on a target structure on the floor of said body of water;

providing acoustic receiving means on at least one of said primary anchor and a running string attached to said primary anchor;

lowering said primary anchor from a surface structure on said running string;

ascertaining an intermediate position of said primary anchor relative to said target structure by analyzing acoustic signals transmitted between said acoustic transmitting means and said acoustic receiving means; and placing said primary anchor upon said floor at a desired position thereof relative to said target structure.

3. The method of claim 2, wherein:

said step of ascertaining the final position of said primary anchor upon said floor includes a step of ascertaining the angular orientation of said primary anchor relative to said target structure, after said primary anchor is placed at its said desired position on the floor of the body of water, by analyzing acoustic signals transmitted between said acoustic transmitting means and said acoustic receiving means.

4. The method of claim 2, wherein:

said step of ascertaining the final position of said primary anchor upon said floor includes a step of ascertaining the lateral location of said primary anchor relative to said target structure, after said primary anchor is placed at its said desired position on the floor of the body of water, by analyzing acoustic signals transmitted between said acoustic transmitting means and said acoustic receiving means.

5. The method of claim 1, said relative position determining means including follower means attached to said main anchor for following guide lines connected between said primary anchor and a surface structure, wherein:

said step of adjusting said relative position determining means is further characterized as adjusting a position of said follower means on said main anchor to angularly orient said main anchor relative to said primary anchor so that said main anchor is in a desired angular orientation when it is engaged with said primary anchor.

6. The method of claim 5, wherein:

said step of lowering said main anchor into engagement with said primary anchor includes a step of connecting said follower means to said guide lines.

7. The method of claim 1, said main anchor being a module main anchor including at least a first and a second module, wherein:

said step of lowering said main anchor includes steps of lowering said first module thereof into engagement with said primary anchor, then lowering said second module to a position adjacent said first module, and then connecting said second module to said first module so that a lateral location and angular orientation of said modular main anchor is determined by a lateral location and angular orientation of said first module thereof.

8. The method of claim 7, further comprising the step of:

setting at least a first and a second pile means through pile guide means of said first and second modules, respectively, of said modular main anchor into said floor of said body of water.

9. The method of claim 8, wherein said steps of setting said first and second pile means in said floor of said body of water each comprise steps of:

drilling a larger diameter hole through one of said modules to a first depth within said floor;

placing a larger diameter pile section in said larger diameter hole;

cementing said larger diameter pile section in said larger diameter hole;

drilling a smaller diameter hole through said one module and through said larger diameter pile section to a second depth greater than said first depth;

placing a smaller diameter pile section within said smaller diameter hole, with an upper end of said smaller diameter pile section extending upward within said larger diameter pile section; and cementing said smaller diameter pile section within said smaller diameter hole.

10. A method of anchoring a tension leg platform, said method including the method of claim 7, and further comprising the steps of:

installing additional underwater anchor assemblies in desired lateral locations and angular orientations relative to said first underwater anchor assembly; and connecting tethers between said underwater anchor assemblies and said tension leg platform.

11. A method of anchoring a tension leg platform, said method including the method of claim 1, and further comprising the steps of:

installing additional underwater anchor assemblies in desired lateral locations and angular orientations relative to said first underwater anchor assembly; and connecting tethers between said underwater anchor assemblies and said tension leg platform.

12. The method of claim 1, said relative position determining means including engagement means for engaging said primary anchor, wherein:

said step of adjusting said relative position determining means is further characterized as adjusting a lateral location of said engagement means on said main anchor to thereby locate said main anchor relative to said primary anchor so that said main anchor is in a desired location when said engagement means of said main anchor is engaged with said primary anchor.

13. The method of claim 12, said engagement means including a vertical pile guide disposed in a horizontally extending slot of said main anchor, wherein:

said step of adjusting the lateral location of said engagement means on said main anchor is further characterized as moving said vertical pile guide horizontally in said slot.

14. The method of claim 12, said relative position determining means including follower means attached to said main anchor for following guide lines connected between said primary anchor and a surface structure, wherein:

said step of adjusting said relative position determining means is further characterized as adjusting a position of said follower means on said main anchor to angularly orient said main anchor relative to said primary anchor so that said main anchor is in a desired angular orientation when it is engaged with said primary anchor.

15. The method of claim 1, wherein:

said step of adjusting said relative position determining means is further characterized as fabricating a portion of said main anchor which engages said primary anchor to thereby position said main anchor in its said desired position when said fabricated portion of said main anchor is engaged with said primary anchor.

16. The method of claim 15, wherein:

said step of lowering the primary anchor to the floor of the body of water is further characterized as setting first and second piles in said floor so that said piles extend upward above said floor for engagement with said main anchor.

17. A method of installing an underwater anchor system for a tension leg platform, said tension leg platform being of the type having at least first, second and third clusters of vertical tethers arranged in a predetermined patttern relative to a target structure located upon a floor of a body of water, said anchor system being of the type having at least first, second and third separate anchor assemblies for attachment to said first, second and third clusters of tethers, respectively, said method comprising the steps of:

lowering a primary anchor of each of said anchor assemblies to said floor;

ascertaining a final position of each of said primary anchors upon said floor relative to one of said target structure and any previously positioned anchor, said position including at least one of a lateral location and an angular orientation about a vertical axis;

comparing said ascertained position of each of said primary anchors to a desired position of a main anchor of its respective anchor assembly;

adjusting a relative position determining means of each of said anchor assemblies, for determining a position of each of said main anchors relative to its respective primary anchor upon engagement of said main anchor with said primary anchor and thereby correcting as necessary for any differences between the ascertained position of each of said primary anchors and the respective desired positions of each of said main anchors; and lowering each of said main anchors into engagement with its respective primary anchor so that a final position of each of said main anchors is determined by its respective relative position determining means, said final position being said desired position of each of said main anchors, so that a lateral location and an angular orientation of each of said first, second and third anchor assemblies relative to said target structure and each other are such that said first, second and third clusters of tethers may be attached thereto in said predetermined pattern with each of said tethers being substantially vertical.

18. The method of claim 17, wherein said first, second and third anchor assemblies are installed sequentially.

19. The method of claim 17, wherein said step of lowering a primary anchor of each of said anchor assemblies to said floor further comprises the steps of:

providing acoustic transmitting means on at least one of said target structure and any previously positioned anchor;

providing acoustic receiving means on at least one of said primary anchor to be lowered and a running string attached to said primary anchor;

lowering each of said primary anchors from a surface structure on said running string;

ascertaining an intermediate position of each of said primary anchors relative to at least one of said target structure and any previously positioned anchor by analyzing acoustic signals transmitted between said acoustic transmitting means and said acoustic receiving means; and placing each of said primary anchors at a desired position thereof upon said floor relative to at least one of said target structure and any previously positioned anchor.

20. The method of claim 19, wherein:

said step of ascertaining a final position of each of said primary anchors upon said floor includes steps of ascertaining the angular orientation of each of said primary anchors, relative to at least one of said target structure and any previously positioned anchor, after said primary anchor is placed at its said desired position on said floor, by analyzing acoustic signals transmitted between said acoustic transmitting means and said acoustic receiving means.

21. The method of claim 19, wherein:

said step of ascertaining a final position of each of said primary anchors upon said floor includes steps of ascertaining the lateral location of each of said primary anchors, relative to at least one of said target structure and any previously positioned anchor, after said primary anchor is placed at its said desired position on said floor, by analyzing acoustic signals transmitted between said acoustic transmitting means and said acoustic receiving means.

22. The method of claim 17, said relative position determining means of each of said anchor assemblies including follower means attached to its respective main anchor for following guide lines connected between its respective primary anchor and a surface structure, wherein:

said step of adjusting the relative position determining means of each of said anchor assemblies includes steps of adjusting a position of each of said follower means on its respective main anchor to angularly orient said main anchor relative to its respective primary anchor so that each of said main anchors is in a desired angular orientation when it is engaged with its respective primary anchor.

23. The method of claim 22, wherein:

said step of lowering each of said main anchors into engagement with its respective primary anchor includes steps of connecting said follower means of each of said anchor assemblies to said guide lines connected between its respective primary anchor and said surface structure.

24. The method of claim 17, at least one of said main anchors being a modular main anchor including at least a first and a second module, wherein:

said step of lowering said one main anchor includes steps of lowering said first module thereof into engagement with its respective primary anchor, then lowering said second module to a position adjacent said first module so that a lateral location and angular orientation of said modular main anchor is determined by a lateral location and angular orientation of said first module thereof.

25. The method of claim 24, further comprising the step of:

setting at least a first and a second pile means through pile guide means of said first and second modules, respectively, of said modular main anchor into said floor of said body of water.

26. The method of claim 25, wherein said steps of setting said first and second pile means in said floor of said body of water each comprise the steps of:

drilling a larger diameter hole through one of said modules to a first depth within said floor;

placing a larger diameter pile section in said larger diameter hole;

cementing said larger diameter pile section in said larger diameter hole;

drilling a smaller diameter hole through said one module and through said larger diameter pile section to a second depth greater than said first depth;

placing a smaller diameter pile section within said smaller diameter hole, with an upper end of said smaller diameter pile section extending upward within said larger diameter pile section; and cementing said smaller diameter pile section within said smaller diameter hole.

27. A method of anchoring said tension leg platform, said method including the method of claim 24 and further comprising the step of:

connecting said first, second and third clusters of vertical tethers between said tension leg platform and said first, second and third anchor assemblies, respectively.

28. A method of anchoring said tension leg platform, said method including the method of claim 17 and further comprising the step of:

connecting said first, second and third clusters of vertical tethers between said tension leg platform and said first, second and third anchor assemblies, respectively.

29. The method of claim 17, said relative position determining means of each of said anchor assemblies including an engagement means for engaging its respective primary anchor, wherein:

said step of adjusting said relative position determining means of each of said anchor assemblies is further characterized as adjusting a lateral location of each of said engagement means on said main anchors to thereby locate said main anchors relative to their respective primary anchors so that said main anchors are each in a desired lateral location when said engagement means of said main anchors are engaged with their respective primary anchors.

30. The method of claim 29, each of said engagement means including a vertical pile guide disposed in a horizontally extending slot of its respective main anchor, wherein:

said step of adjusting the lateral location of each of said engagement means on said main anchors is further characterized as moving said vertical pile guides horizontally in said slots.

31. The method of claim 30, said relative position determining means of each of said anchor assemblies including follower means attached to its respective main anchor for following guide lines connected between its respective primary anchor and a surface structure, wherein:

said step of adjustng the relative position determining means of each of said anchor assemblies includes steps of adjusting a position of each of said follower means on its respective main anchor to angularly orient said main anchor relative to its respective primary anchor so that each of said main anchors is in a desired angular orientation when it is engaged with its respective primary anchor.

32. The method of claim 17, wherein:

said step of adjusting a relative position determining means of each of said anchor assemblies is further characterized as fabricating a portion of each of said main anchors which engages its respective primary anchor to thereby position said main anchors in their said desired positions when said fabricated portions of said main anchors are engaged with said primary anchors.

33. The method of claim 32, wherein:

said step of lowering the primary anchor of each of said anchor assemblies to said floor is further characterized as setting first and second piles in said floor so that said piles extend upward above said floor for engagement with the respective main anchor of each of said anchor assemblies.

34. An anchor assembly, comprising:

a primary anchor adapted to be placed upon a floor of a body of water;

a main anchor adapted to be lowered into engagement with said primary anchor; and relative position determining means for interconnecting said primary anchor and said main anchor and for determining a position of said main anchor relative to said primary anchor upon engagement of said main anchor with said primary anchor, said relative position determining means including adjustment means for adjusting said position of said main anchor relative to said primary anchor, said position including at least one of a lateral location and an angular orientation about a vertical axis.

35. The anchor assembly of claim 34, wherein:

said relative position determining means includes guideline means for connecting said primary anchor to a floating structure, and includes follower means attached to said main anchor for engaging said guideline means and orienting said main anchor relative to said guideline means.

36. The anchor assembly of claim 35, wherein:

said adjustment means includes a ring attached to said main anchor, said follower means being attached to said ring, said ring and follower means being so constructed that a radial position of said follower means about a central axis of said ring is variable.

37. The anchor assembly of claim 34, wherein:

said adjustment means of said relative position determining means includes a vertical pile means horizontally adjustable in location within a horizontal slot of said main anchor.

38. The anchor assembly of claim 34, further comprising:

means for ascertaining a final position of said primary anchor upon said floor of said body of water.

39. The anchor assembly of claim 38, wherein said ascertaining means includes:

acoustic transmitting means connected to a target structure on the floor of said body of water;

acoustic receiving means, attached to at least one of said primary anchor and a running string attached to said primary anchor for lowering said primary anchor from a floating structure; and acoustic signal processing means for analyzing acoustic signals transmitted between said acoustic transmitting means and said acoustic receiving means.

40. The anchor assembly of claim 34, wherein:

said main anchor includes at least a first and a second module, said first module being adapted for engagement with said primary anchor with said relative position determining means interconnecting said primary anchor and said first module so that said lateral location and angular orientation of said main anchor is determined by a lateral location and angular orientation of said first module thereof.

41. The anchor assembly of claim 40, further comprising:

first and second pile means extending through pile guide means of said first and second modules, respectively, of said main anchor into said floor of said body of water.

42. The anchor assembly of claim 41, wherein:

said first pile means includes a larger diameter pile section having a first length and being cemented within said floor, and a smaller diameter pile section having a second length greater than said first length with a portion of said smaller diameter pile section below said larger diameter pile section being cemented in said floor and an upper portion of said smaller diameter pile section extending upward within said larger diameter pile section.

43. A combination of a buoyant platform, an underwater anchor system and a plurality of vertical tethering elements connecting said platform and said anchor system, said anchor system including the anchor assembly of claim 34, wherein:

said anchor system further includes at least second and third anchor assemblies separate from said first anchor assembly; and said plurality of tethering elements includes at least first, second and third clusters of tethering elements arranged in a predetermined pattern and connected to said first, second and third anchor assemblies, respectively.

* * * * *